US011168964B2

(12) United States Patent
Finsand

(10) Patent No.: US 11,168,964 B2
(45) Date of Patent: Nov. 9, 2021

(54) CONCEALABLE HANDGUN MAGAZINE POCKET CLIP

(71) Applicant: Amend2, LLC, Idaho Falls, ID (US)

(72) Inventor: Andy Finsand, American Fork, UT (US)

(73) Assignee: AMEND 2. LLC, Idaho Falls, ID (US)

( * ) Notice: Subject to any disclaimer, the term of this patent is extended or adjusted under 35 U.S.C. 154(b) by 0 days.

(21) Appl. No.: 15/900,688

(22) Filed: Feb. 20, 2018

(65) Prior Publication Data

US 2019/0257631 A1 Aug. 22, 2019

(51) Int. Cl.
*F42B 39/02* (2006.01)

(52) U.S. Cl.
CPC ..... *F42B 39/02* (2013.01)

(58) Field of Classification Search
CPC ..... F42B 39/02; F42B 39/08; F42B 39/082; F42B 39/085
USPC ..... 224/587
See application file for complete search history.

(56) References Cited

U.S. PATENT DOCUMENTS 1,652,972 A * 12/1927 Beck ..... F16B 2/241 24/3.12
6,571,997 B2 * 6/2003 Dedrick ..... A45F 5/00 224/183
8,371,487 B1 * 2/2013 Plappert ..... F41C 33/0236 224/193
9,746,299 B1 * 8/2017 Davis ..... F42B 39/02
9,801,455 B2 * 10/2017 Christoff ..... A45F 5/00
9,927,218 B1 * 3/2018 Schlang ..... F42B 39/02
2013/0306693 A1 * 11/2013 Prestwich ..... A45F 5/00 224/269
2014/0109455 A1 * 4/2014 Chiang ..... F42B 39/02 42/90
2014/0262892 A1 * 9/2014 Orozco ..... F42B 39/02 206/424
2018/0031351 A1 * 2/2018 Sitz ..... F41C 33/0236

OTHER PUBLICATIONS

A photograph of a hand gun with pocket clip, purportedly taken of Clip Draw product and purportedly shown in Brownell's Catalog as early as 2001.
"No-Holster Carry It's the Clipdraw Connection" (LOFGREN) https://web.archive.org/web/20040405021343/http://clipdraw.com:80/charticle.html; Apr. 5, 2004.
"To dumb gun-ignorant liberals: Magazine size" (PAINE) http://airbyrne.blogspot.com/2013/02; Feb. 19, 2013.
A photograph of two hand gun pocket clips on a wooden plank, purportedly taken of Clip Draw products as early as early as 2001.
(Continued)

*Primary Examiner* — Derek J Battisti
(74) *Attorney, Agent, or Firm* — Loyal Intellectual Property Law, PLLC; Travis Banta

(57) ABSTRACT

Disclosed herein is a concealable handgun magazine pocket clip which consistently and reliably holds a handgun magazine in a pocket, such as a pants pocket, waistband, or other article of clothing or personal accessory for easy and quick access. The handgun magazine pocket clip includes a body, including a clip. The handgun magazine pocket clip further includes an elastic loop attached to the body.

20 Claims, 3 Drawing Sheets

(56) References Cited

OTHER PUBLICATIONS

A photograph of two hand gun pocket clips taken from the rear position shown against a wooden background, purportedly taken of Clip Draw products as early as early as 2001.
A post from the Technaclip Facebook page, https://www.facebook.com/TechnaClip/photos/a.2665 18553390021/668318023210070/?type=3&theater; Mar. 26, 2014.
A post from the Technaclip Facebook page, https://www.facebook.com/TechnaClip/photos/a.266518553390021/729787003729838/?type=3&theater; Oct. 30, 2014.

* cited by examiner

CONCEALABLE HANDGUN MAGAZINE POCKET CLIP

BACKGROUND

1. Technical Field

This disclosure relates generally to a pocket clip for carrying a handgun magazine in a concealed fashion. More specifically, the device disclosed herein relates to a clip designed to be retained in, for example, a pants pocket, that secures a handgun magazine in a concealed, albeit easily accessible, manner.

2. Description of the Related Art

Carrying a weapon is a serious responsibility that many citizens and police officers undertake to ensure the safety of themselves and others. To that end, many states in the United States have provisions for certain citizens to obtain a permit to carry a concealed weapon while other states adopt a "Constitutional Carry" ordinance that allows anyone who is legally allowed to possess a gun to carry it concealed. One important distinction in concealed carry permit states, however, is that these states do not authorize concealed weapons permit holders to carry a handgun openly. These concealed weapons permit holders are required, as a condition of their permit in many cases, to ensure that their weapons are concealed from the public's view. Further, even in Constitutional Cary states, it may be tactically advisable to keep a weapon concealed as opposed to carrying it openly.

Many different types of holsters have been developed to aid citizens and undercover police officers/law enforcement agents who carry concealed weapons safely conceal their weapons. Holsters known as IWB holsters (inside the waistband), under the arm cross-draw holsters, ankle holsters, purse holsters, and many others are designed to hold a concealed weapon in a convenient, accessible, and most importantly, safe position during the wearer's daily activities. Some of these holsters include pouches to carry handgun magazines and other accessories. Unfortunately, holsters that implement these pouches are notoriously uncomfortable to wear which discourages use.

Little has been done in the art of concealable magazine holsters. While it is not a requirement for citizens who carry a concealed weapon to further conceal a magazine, many citizens and police officers/law enforcement agents choose to conceal any gun related paraphernalia for tactical reasons. For example, if a criminal sees a citizen wearing a magazine holster with a loaded handgun magazine, the criminal may naturally infer that the citizen must also have a gun. In such a case, the citizen concealed weapon holder may become the criminal's first target because the citizen with the weapon has the ability, by force, to stop a criminal intending to do harm to others. Further, many citizens who carry a concealed weapon choose to carry unloaded. That is to say that many citizens, because of the particular mechanism of their weapon (e.g., striker-fired, SAO (single action only), DAO (double action only), or so called "cocked-and-locked" mechanisms) and other reasons, choose to not carry out their daily activities with the handgun loaded or having a loaded magazine in the handgun without having a bullet loaded in the chamber of the handgun. Unfortunately, conventional solutions have not provided a consistent or reliable mechanism for carrying a handgun magazine in a concealed fashion.

It is therefore one object of this disclosure to provide a concealable handgun magazine pocket clip. An additional object is to provide a concealable handgun magazine pocket clip that secures the magazine in a consistent and reliable location during use. It is a further object of this disclosure to provide a concealable handgun magazine pocket clip that allows the handgun magazine to be quickly removed from a pocket and easily disconnected from the pocket clip.

SUMMARY

Disclosed herein is a concealable handgun magazine pocket clip which consistently and reliably holds a handgun magazine in a pocket, such as a pants pocket, waistband, or other article of clothing or personal accessory for easy and quick access. The handgun magazine pocket clip includes a body, including a clip. The handgun magazine pocket clip further includes an elastic loop attached to the body.

BRIEF DESCRIPTION OF THE DRAWINGS

The accompanying drawings illustrate one or more embodiments concealable handgun magazine pocket clip.

DETAILED DESCRIPTION OF PREFERRED EMBODIMENTS

In the following description, for purposes of explanation and not limitation, specific techniques and embodiments are set forth, such as particular techniques and configurations, in order to provide a thorough understanding of the device disclosed herein. While the techniques and embodiments will primarily be described in context with the accompanying drawings, those skilled in the art will further appreciate that the techniques and embodiments may also be practiced in other similar devices.

Reference will now be made in detail to the exemplary embodiments, examples of which are illustrated in the accompanying drawings. Wherever possible, the same reference numbers are used throughout the drawings to refer to the same or like parts. It is further noted that elements disclosed with respect to particular embodiments are not restricted to only those embodiments in which they are described. For example, an element described in reference to one embodiment or figure, may be alternatively included in another embodiment or figure regardless of whether or not those elements are shown or described in another embodiment or figure. In other words, elements in the figures may be interchangeable between various embodiments disclosed herein, whether shown or not.

An important distinction of terms is necessary at the outset to define terms used herein. For example, it should be noted that the term "clip" as used herein refers to a "pocket clip," such as the pocket clip labeled element 105, shown in FIG. 1. The term "clip" is not interchangeable for the word "magazine," as used herein. A "magazine" includes those devices which typically include a spring-loaded follower designed to push rounds of ammunition into a chamber of a firearm when the firearm is first cocked/loaded or after a previous casing has been ejected from the firearm. No use of the term "clip" used herein should be interpreted as referring to "ammunition clips" which typically lack a spring-loaded follower and hold ammunition in a fashion to be inserted into the magazine of a firearm.

Figure 1:
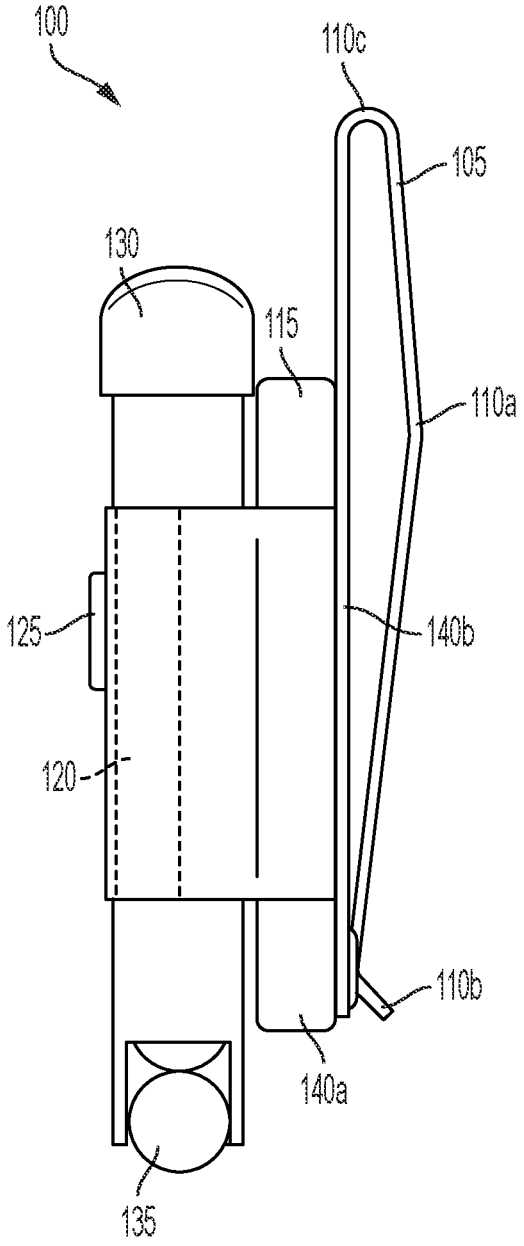
FIG. 1 illustrates a side view of a concealable handgun magazine pocket clip with a handgun magazine installed.

FIG. 1 illustrates a side view of handgun magazine pocket clip 100. Handgun magazine pocket clip 100 includes a pocket clip 105 which is typically constructed using a metal, metal alloy, or composite material. In one example, pocket clip 105 is constructed using spring steel. As will be discussed below, pocket clip 105 includes a loop intended to catch on the top of a pocket, waistband, belt, personal accessory, or any other edge of clothing material. As used herein, the term "pocket" is merely exemplary and is meant to be interpreted as including any of the foregoing examples without specific reference. Pocket clip 105 is attached, directly or indirectly, to body 115 and pocket clip 105 includes a radiused bend at an apex 110*c* of the pocket clip, an angular bend 110*a* disposed between the apex 110*c* of the pocket clip 105 and a splay 110*b* that terminates pocket clip 105. Angular bend 110*a* provides a space between pocket clip 105 and body 115 to accommodate fabric, leather, and/or any other material to which handgun magazine pocket clip 100 may be attached. Splay 110*b* is intended to facilitate pocket clip 105 in correctly catching on the top of a pocket. Pocket clip 105 includes a longitudinal portion where pocket clip 105 connects to body 115 of handgun magazine pocket clip 100. Body 115 of handgun magazine pocket clip is typically constructed using a hard plastic material. Examples of plastic materials include nylons, acrylics, PVC, UPVC, polyethylene (high density or low density), polypropylene, polycarbonate, Bakelite, epoxy resins, melamines, and polymers including, for example, polyoxymethylene. Body 115 is typically constructed in two pieces which are fastened together using conventional attachments known in the art, such as threaded screws. In one embodiment, body 115 includes a front piece 140*a* and a back or rear piece 140*b* which includes pocket clip 105. The front piece 140*a* of body 115 typically includes threaded or unthreaded stands which mate with four countersunk screw holes in the rear piece of body 115. Screws may be installed through the four countersunk screw holes in the rear piece 140*b* of body 115 into the threaded or unthreaded stands of the front piece 140*a* of body 115. The longitudinal portion of pocket clip 105 may also be connected to the rear piece 140*h* of body 115 by screws, rivets, welding, brazing, and/or any other conventional fastener or fastening method. Alternatively, pocket clip 105 may be integrally formed as part of the rear piece 140*h* of body 115.

Handgun magazine pocket clip 100 further includes a silicon badge 125 which may be mounted on elastic material 120. In one embodiment, silicon badge 125 serves as a surface that is designed to create friction between handgun magazine pocket clip 100 and a user's shirt or skin. In one embodiment, letters may be impressed into badge 125, such as a company name, that provides additional points of friction between handgun magazine pocket clip 100 or elastic material 120 and the user's clothing or skin. The friction created between handgun magazine pocket clip 100 and elastic material 120 may tend to retain handgun magazine pocket clip 100 in place on a user's belt or pocket, for example, while magazine 130 is withdrawn from handgun magazine pocket clip 100.

Elastic material 120 is fastened between the front piece 140*a* of body 115 and the rear piece 140*b* of body 115 on both sides of body 115 via the aforementioned fasteners such that elastic material 120 forms an elasticized loop of elastic material 120 captured between the front piece 140*a* of body 115 and the rear piece 140*b* of body 115. Elastic material 120 may be constructed or woven from materials such as spandex, stretch vinyl, nylon, lycra, and other stretchable fabrics. Stretchable fabrics include those fabrics which may be substantially elongated (by 2% or more overall length) under hand pressure and return to an original length when pressure is released without breaking or permanently deforming. In one embodiment, elastic material 120 may be fitted with or otherwise attached to a plastic liner (not shown) which is disposed along an inside surface (body 115) side of elastic material 120. The plastic liner may include lips that ride over the top and bottom edge of elastic material 120 to facilitate insertion or removal of handgun magazine 130 from handgun magazine pocket clip 100. This plastic liner may provide rigidity to elastic material 120 and decrease the friction created between handgun magazine 130 and elastic material 120. Further, this plastic liner may prevent recesses (which are cut into handgun magazine 130 for operational purposes) from snagging on elastic material 120 when handgun magazine 130 is drawn from handgun magazine pocket clip 100. A plastic liner may further prevent bullets 135 disposed within magazine 130 which may or may not be entirely properly aligned within magazine 130 from catching on elastic material 120 when handgun magazine 130 is drawn from handgun magazine pocket clip 100 (for example, if a bullet 135 slides forward within magazine 130 such that the bullet overhangs an edge of magazine 130).

In practice, a user may install handgun magazine pocket clip 100 in a pocket, such as a pants pocket, waistband, or belt. Handgun magazine pocket clip 100 is not limited to use in pockets and can be used wherever a lip exists on clothing or bags that handgun magazine pocket clip 100 may pinch between pocket clip 105 and body 115. Handgun magazine pocket clip 100 may be installed in a pocket by inserting body 115 of handgun magazine pocket clip 100 into the pocket while splay 110*b* causes the lip of the pocket, for example, to catch between body 115 and pocket clip 105. As handgun magazine pocket clip 100 is inserted into the pocket, the lip of the pocket will eventually come into contact with the loop at the apex 110*c* of pocket clip 105 and stop. At this point, handgun magazine pocket clip 100 is fully seated in the pocket. The outside of the loop of pocket clip 105 and splay 110*b* remain inconspicuously and unobtrusively on the outside of the pocket. Similarly, handgun magazine pocket clip 100 may be installed on a waistband or belt by inserting body 115 of handgun magazine pocket clip into the inside of a pair of pants while splay 110*b* causes the lip of the waistband or belt to catch between body 115 and pocket clip 105. Further inserting handgun magazine pocket clip 100 into the pair of pants fully seats the lip of the waistband or belt against the loop of pocket clip 105 in an inconspicuous and unobtrusive position inside the user's pants.

Handgun magazine 130 may be inserted into handgun magazine pocket clip 100 by inserting the top end (the end to which the spring-loaded magazine follower pushes ammunition), into the loop in elastic material 120. The bottom end of handgun magazine 130 may come to rest on the loop in the elastic material and against body 115. In this fashion, handgun magazine 130 may be consistently and reliably positioned at the same place within a user's pocket or waistband/belt at all times. Further, since handgun magazine 130 may be inserted into the pocket or waistband/belt up to the rear end of the handgun magazine, the handgun magazine may be fully inserted within the pocket or pants without having any portion of the magazine raising out of the pocket or above the pants, or in other words, above the top most portion of pocket clip 105. So long as the highest part of handgun magazine 130 in the pocket or pants is lower than the top of pocket clip 105, handgun magazine 130 may be fully concealed within the pocket.

When the user desires to draw handgun magazine 130, the user may simply reach into the pocket (or pants) with her hand, grasp handgun magazine 130 by the rear end, and pull. The loop in elastic material 120 allows handgun magazine 130 to elongate and slide free from handgun magazine 130. Handgun magazine 130 may therefore be freely drawn from the pocket and inserted into a handgun, as required.

Figure 2:
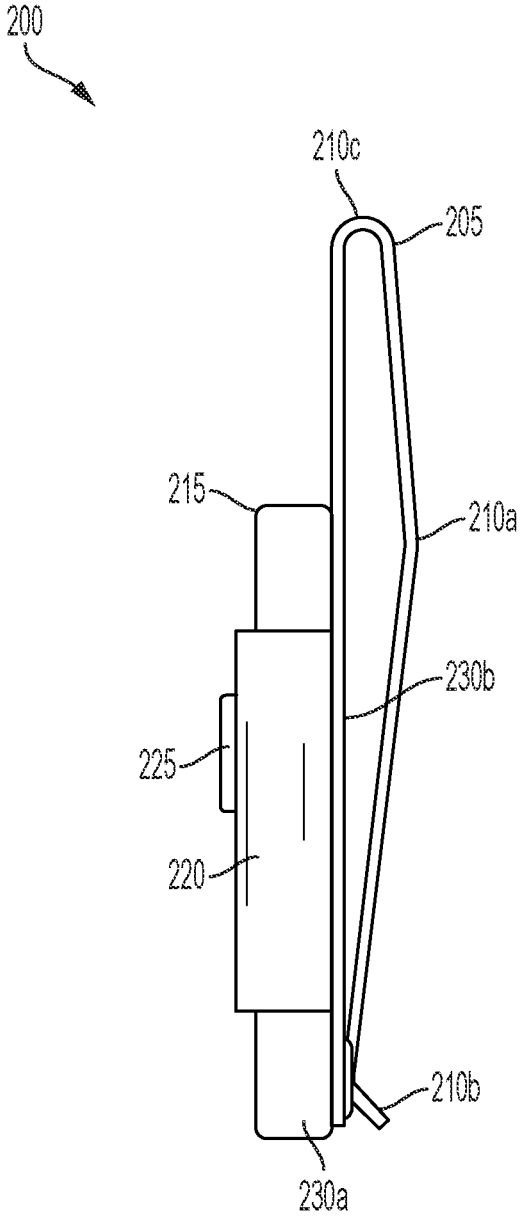
FIG. 2 illustrates a side view of the concealable handgun magazine pocket clip.

FIG. 2 illustrates a side view of concealable handgun magazine pocket clip 200 which is similar in implementation and description to handgun magazine pocket clip 100, shown in FIG. 1. However, in FIG. 2, handgun magazine pocket clip 200 is shown without a handgun magazine installed. Handgun magazine pocket clip 200 includes a pocket clip 205 which is typically constructed using spring steel. As will be discussed below, pocket clip 205 includes a loop intended to catch on the top of a pocket, waistband, or belt which is a radiused bend at an apex 210*c* of pocket clip 205. Pocket clip 205 also includes an angular bend 210*a* disposed between the apex 210*c* of the pocket clip and a splay 210*b*. Angular bend 210*a* provides a space between pocket clip 205 and body 215 to accommodate fabric, leather, and/or any other material to which handgun magazine pocket clip 200 may be attached. Splay 210*b* may facilitate pocket clip 205 in correctly catching on the top of a pocket. Pocket clip 205 includes a longitudinal portion where pocket clip 205 connects to body 215 of handgun magazine pocket clip 200. A front piece 230*a* of body 215 of handgun magazine pocket clip 200 may be constructed using polyoxymethylene while a back or rear piece 230*b* of body 215 may be constructed using spring steel. Body 215 is typically constructed in two pieces which are fastened together using conventional attachments known in the art, such as threaded screws. In one embodiment, body 215 includes a front piece 230*a* and a rear piece 230*b*. The front piece 230*a* of body 215 typically includes threaded or unthreaded stands which mate with four countersunk screw holes in the rear piece 230*b* of body 215. Screws may be installed through the four countersunk screw holes in the rear piece 230*b* into the threaded or unthreaded stands of the front piece 230*a* of body 215. The longitudinal portion of pocket clip 205 may also be connected to the rear piece 230*b* of body 215 by screws, rivets, welding, brazing, and/or any other conventional fastener or fastening method. Alternatively, pocket clip 205 may be formed as an integral part of the rear piece 230*b* of body 215.

Handgun magazine pocket clip 200 includes elastic material 220 which is fastened between the front piece 230*a* of body 215 and the rear piece 230*b* of body 215 on both sides of body 215 via the aforementioned fasteners. In this embodiment, elastic material 220 may secure a handgun magazine to body 215 with elastic pressure.

As before, elastic material 220 may have badge 225 attached thereto. Badge 225 may be constructed from silicon and similar materials to serve as a surface that is designed to create friction between handgun magazine clip 200 and a user's clothing or skin. In one embodiment, letters may be impressed into badge 225, such as a company name, that provides additional points of friction between handgun magazine pocket clip 200 or elastic material 220 and the user's clothing or skin. The friction created between handgun magazine pocket clip 200 and elastic material 220 may tend to retain handgun magazine pocket clip 100 in place on a user's belt or pocket, for example, when a handgun magazine is withdrawn from handgun magazine pocket clip 200.

Figure 3:
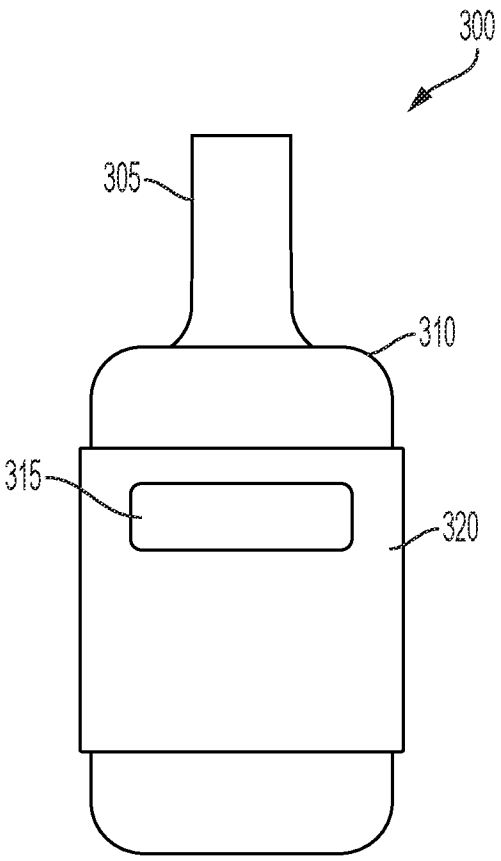
FIG. 3 illustrates a front view of the concealable handgun magazine pocket clip.

FIG. 3 illustrates a front view of concealable handgun magazine pocket clip 300, which is similar in implementation and description to handgun magazine pocket clips 100 and 200 shown in FIG. 1 and FIG. 2, respectively. In FIG. 3, handgun magazine pocket clip 300 includes a pocket clip 305 which is attached to body 310 of handgun magazine pocket clip 300. Handgun magazine pocket clip 300 also includes a silicon badge 315 attached to elastic loop 320 to provide friction between handgun magazine pocket clip 300 and a user's clothing or skin. Elastic loop 320 is connected to body 310 to form a continuous loop of elasticized material. Further, as described above, elastic loop 320 may further include a plastic liner disposed on the inside of elastic loop 320.

As shown in FIG. 3, handgun magazine pocket clip 300 is universal for all, or nearly all, types and makes of handgun magazines. While the width of elastic loop 320 may vary, elastic loop 320 is designed such that any stock and some aftermarket handgun magazines will be securely and reliably held in place regardless of caliber and regardless of whether the magazine is a single stack magazine or a double stack magazine. Further, handgun magazine pocket clip 300 secures the magazine in such a position as to make any, or nearly any, handgun magazine readily accessible to the user.

In another embodiment, handgun magazine pocket clip 300 may provide elastic loop 320 in different sizes to more specifically accommodate magazines that are intended to hold smaller or larger caliber bullets. For example, elastic loop 320 may be smaller when configured to hold magazines that contain .22 caliber to .30 caliber bullets. Alternatively, elastic loop 320 may be larger when configured to hold magazines that contain .30 caliber bullets to .45 caliber bullets. While such an approach increases manufacturing costs, providing elastic loop 320 in one of two, or more depending on implementation, specific sizes may result in ideal tension to hold a handgun magazine of a particular size securely within handgun magazine pocket clip 300.

Figure 4:
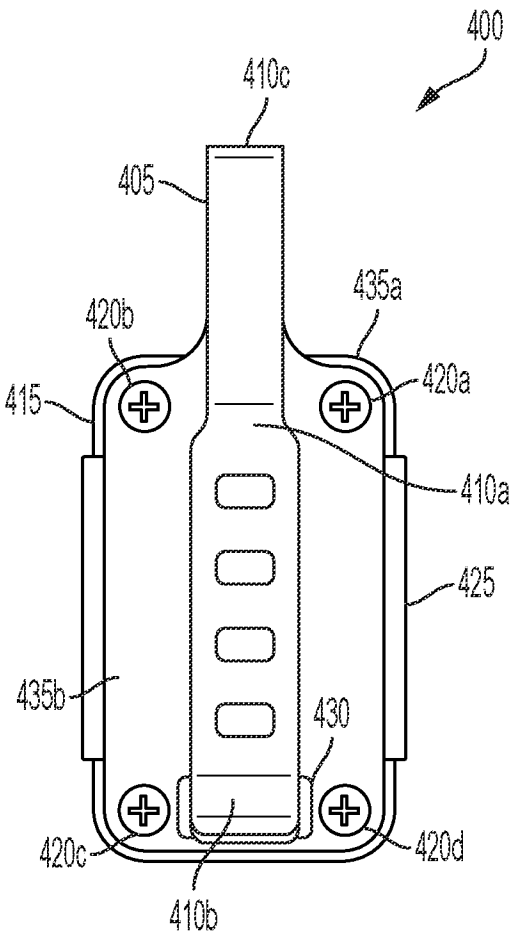
FIG. 4 illustrates a rear view of the concealable handgun magazine pocket clip.

FIG. 4 illustrates a rear view of the concealable handgun magazine pocket clip 400 which may be implemented as described with respect to the foregoing description. Handgun magazine pocket clip 400 includes a pocket clip 405. Pocket clip 405, as discussed previously, includes a loop intended to catch on the top of a pocket, waistband, or belt. Pocket clip 405 is attached, directly or indirectly, to body 415 and includes a radiused bend at an apex 410*c* of the pocket clip and an angular bend 410*a* disposed between the apex 410*c* of pocket clip 405 and splay 410*b* that terminates pocket clip 105. Angular bend 410*a* provides a space between pocket clip 405 and body 415 to accommodate fabric, leather, and/or any other material to which handgun magazine pocket clip 400 may be attached. Splay 410*b* is intended to assist a user in catching the top of a pocket with pocket clip 405 when handgun magazine pocket clip 400 is installed in the pocket. Pocket clip 405 may be attached by conventional fasteners (screws, rivets, adhesives, etc) to body 415 or may be formed integrally as part of a back or rear piece of body 415. Also, as shown in FIG. 4, pocket clip 405 may include one or more through-hole in-relief punchings between angular bend 410 and splay 410*b* to decrease an overall weight of handgun magazine pocket clip 400.

As discussed above, body 415 may be implemented as a single piece or as two separate pieces. In the embodiment shown in FIG. 4, body 415 includes two separate pieces, a front piece 435*a* and a back or rear piece 435*b*. Further, in the embodiment of FIG. 4, the rear piece 435*b* of body 415 may be integrally formed with pocket clip 405. Pocket clip 405 is shown connecting to body 415 by four screws 420*a*, 420*b*, 420*c*, and 420*d*. Screws 420*a*-420*d* secure the rear piece 435*b* of body 415 to the front piece 435*a* of body 415. Further, when screws 420*a*-420*d* are installed, screws 420*a*-420*d* pinch elastic loop 425 between the front piece 435*a* of body 415 and the rear piece 435*b* of body 415 to tightly capture and secure elastic loop 425 in place. In other words, the front piece 435*a* of body 415 and the rear piece 435*b* of body 415 may compress elastic loop 425 between them as screws 420*a*-420*d* are installed between the front piece 435*a* of body 415 and the rear piece 435*b* of body 415 such that elastic loop 425 is firmly secured in place.

FIG. 4 further illustrates a pocket fabric friction enhancing device, also referred to as catch 430. As shown in FIG. 4, catch 430 is implemented as a rubber pad on a rear surface of body 415. In one embodiment, catch 430 may be disposed on a rear surface of body 415 at a point where pocket clip 405 contacts the rear surface of body 415, near splay 410*b* of pocket clip 405. As with silicone badge 125, 225, and 315 shown in FIGS. 1-3 above, catch 430 may be formed using the same or other materials, such as rubber. The guiding principle for any of badges 125, 225, and 315, or catch 430, remains a material with a "tacky material" defined as those materials which include a tacky surface, such as rubber, silicon, silicone or other plastics and polymers, may be implemented. As handgun magazine pocket clip 400 is installed in a user's pocket, pocket clip 405 is designed to clip on the outside of the pocket or waistband/belt and press the fabric of the pocket or pants against catch 430. Further, since catch 430 is constructed from a material with a tacky surface, catch 430 uses friction to ensure that when handgun magazine is pulled from handgun magazine pocket clip 400, the handgun magazine pulls up and cleanly away from handgun magazine pocket clip 400 and leaving handgun magazine pocket clip 400 firmly attached to the user's pocket. In other words, catch 430 is designed to ensure that handgun magazine pocket clip 400 remains in place even when the handgun magazine is quickly removed from handgun magazine pocket clip 400. Thus, catch 430 provides a distinct advantage in that as catch 430 stays in place, the user is able to quickly separate a handgun magazine from handgun magazine pocket clip 400 and ensure that the handgun magazine is ready to be inserted into the handgun for use, without having to separately remove handgun magazine pocket clip 400 from the pocket, and then remove handgun magazine pocket clip 400 from the magazine.

Other embodiments of handgun magazine pocket clip 400, have been conceived. For example, to decrease the profile of handgun magazine pocket clip 400, pocket clip 405 may be attached, using conventional fasteners, to the front of body 415 instead of the back of body 415. Further, a channel (not shown) may be disposed on the front of body 415 to accommodate pocket clip 405. In one embodiment, the depth of the channel in the front of body 415 may be substantially the same as or deeper than the thickness of the metal used to create pocket clip 405 such that pocket clip 405 does not catch on a handgun magazine as the magazine is drawn. To further ensure that pocket clip 405 does not catch on a handgun magazine when the handgun magazine is drawn from handgun magazine pocket clip 400, the front of body 415 may include parallel rails (not shown) extending along the length of the body in parallel with a vertical axis defined by pocket clip 405. These rails may raise portions of body 415 such that when a handgun magazine is drawn, the handgun magazine only contacts the rails. This feature decreases the likelihood that the magazine will catch on handgun magazine pocket clip 400 and decreases the friction between the handgun magazine and body 415, enabling the user to slide the handgun magazine out faster and with less effort.

In this embodiment, pocket clip 405 may loop from the front of body 415 to the back of body 415 and thereafter substantially follow the contour of body 415 and catch 430. Pocket clip 405 may terminate after catch 430 with splay 410*b* acting as a lock to maintain a firm grip on fabric material, such as denim, between pocket clip 405 and the back of body 415. Because pocket clip 405 substantially follows the contour of the back of body 415, handgun magazine pocket clip 400 may be implemented in a slim profile configuration.

In some embodiments, a user may prefer to access a magazine horizontally rather than vertically. Thus, handgun magazine pocket clip 400 may include one or more gears (not shown) with a locking mechanism (not shown) that allows handgun magazine pocket clip 400 to rotate by substantially 90 degrees (the term "substantially" meaning within 5 degrees of 90 degrees). Thus, instead of a handgun magazine being disposed in an axis parallel to pocket clip 405, the handgun magazine may be rotated such that the handgun magazine is substantially perpendicular to pocket clip 405. A locking mechanism may be provided to allow handgun magazine pocket clip 400 to rotate as desired and lock in place when desired. Thus, handgun magazine pocket clip 400 may be selectively rotated such that the handgun magazine is parallel or perpendicular to pocket clip 405 based on the user's desires.

The foregoing description has been presented for purposes of illustration. It is not exhaustive and does not limit the invention to the precise forms or embodiments disclosed. Modifications and adaptations will be apparent to those skilled in the art from consideration of the specification and practice of the disclosed embodiments. For example, components described herein may be removed and other components added without departing from the scope or spirit of the embodiments disclosed herein or the appended claims.

Other embodiments will be apparent to those skilled in the art from consideration of the specification and practice of the disclosure disclosed herein. It is intended that the specification and examples be considered as exemplary only, with a true scope and spirit of the invention being indicated by the following claims.

What is claimed is:

1. A handgun magazine clip, comprising:

a body having a front piece and a rear piece, the rear piece including a clip that extends above the body wherein the clip is a top most portion of the handgun magazine clip, a catch that is disposed on the rear piece of the body between the clip and the body, an elasticized loop is formed from elasticized material where both a first end and a second end of the elasticized material are attached to the body between the front piece and the rear piece of the body creating the elasticized loop such that both the first end and the second end of the elasticized loop are compressed and secured in place between the front piece and the rear piece of the body, the front piece and the rear piece being fastened together by one or more fasteners to compress and secure the elasticized loop in place;

wherein the elasticized loop is sized to encircle a handgun magazine such that when the handgun magazine is inserted into the elasticized loop a highest portion of the handgun magazine is lower than the top most portion of the clip and the handgun magazine is secured to the body by elastic pressure from the elasticized loop; and a friction badge that is attached to the elasticized loop.

2. The handgun magazine clip of claim 1, wherein the clip is attached to the rear piece of the body.

3. The handgun magazine clip of claim 2, wherein the clip is integrally formed with the rear piece of the body.

4. The handgun magazine clip of claim 1, wherein the front piece and the rear piece of the body are connected by one or more fasteners.

5. The handgun magazine clip of claim 1, wherein the clip includes a loop, defining an apex of the clip.

6. The handgun magazine clip of claim 5, wherein the clip further includes a splay.

7. The handgun magazine clip of claim 6, wherein the clip includes an angular bend disposed between the apex of the clip and the splay of the clip.

8. The handgun magazine clip of claim 1, wherein the clip includes one or more through-hole punchings.

9. The handgun magazine clip of claim 1, further comprising the badge attached to an outside surface of the elasticized loop.

10. The handgun magazine clip of claim 9, wherein the badge is constructed from a tacky material.

11. The handgun magazine clip of claim 1, further comprising a catch disposed on a rear surface of the body.

12. The handgun magazine clip of claim 11, wherein the catch is implemented as a tacky material.

13. The handgun magazine clip of claim 11, wherein the catch is disposed on a rear surface of the body at a point where the clip contacts the rear surface of the body.

14. The handgun magazine clip of claim 1, wherein the clip is constructed of spring steel.

15. The handgun magazine clip of claim 1, wherein the elasticized loop is configured to secure a handgun magazine to a front piece of the body.

16. The handgun magazine clip of claim 15, wherein the elasticized loop is configured to secure a handgun magazine to a front piece of the body at a point where a highest portion of the handgun magazine is disposed below an apex of the clip.

17. The handgun magazine clip of claim 1, wherein the front piece of the body is constructed of a plastic material and the back piece of the body is constructed of spring steel.

18. The handgun magazine clip of claim 1, wherein the clip provides a continuous space between the clip and the body between an apex of the clip and a point at a splay of the clip where the clip contacts the body.

19. The handgun magazine clip of claim 1, wherein one of the one or more fasteners is a screw.

20. The handgun magazine clip of claim 1, wherein on of the one or more fasteners attaches through the rear piece to the front piece.

* * * * *